US005096038A

United States Patent [19]

Potter et al.

[11] Patent Number: 5,096,038

[45] Date of Patent: Mar. 17, 1992

[54] THREAD DETECTOR ASSEMBLY

[75] Inventors: Michael Potter; David C. Reeves, both of Hampshire, England

[73] Assignee: De La Rue Systems Limited, England

[21] Appl. No.: 566,259

[22] Filed: Aug. 13, 1990

[30] Foreign Application Priority Data

Aug. 16, 1989 [GB] United Kingdom ..... 8918699

[51] Int. Cl.[5] ..... G07F 7/04

[52] U.S. Cl. ..... 194/210; 209/534

[58] Field of Search ..... 194/205, 206, 210; 209/534, 567, 570; 235/449

[56] References Cited

U.S. PATENT DOCUMENTS

| | | | |
|---|---|---|---|
| 3,245,534 | 4/1966 | Smith et al. | 209/567 X |
| 3,293,543 | 12/1966 | Nelson et al. | 194/210 X |
| 3,362,532 | 1/1968 | Riddle et al. . | |
| 3,509,535 | 4/1970 | Berube | 194/210 X |
| 3,578,124 | 5/1971 | Flum | 194/210 |
| 3,753,255 | 8/1973 | Di Veto | 235/449 X |
| 4,187,463 | 2/1980 | Kivenson | 209/534 X |
| 4,255,652 | 3/1981 | Weber | 194/210 X |
| 4,349,111 | 9/1982 | Shah et al. | 209/534 |
| 4,584,529 | 4/1986 | Aoyama | 209/534 X |
| 4,592,090 | 5/1986 | Curl et al. | 209/534 X |
| 4,749,087 | 6/1988 | Buttifant | 209/534 |
| 4,809,966 | 3/1989 | Kobayashi et al. | 194/206 X |

FOREIGN PATENT DOCUMENTS

| | | | |
|---|---|---|---|
| 2619457 | 11/1977 | Fed. Rep. of Germany | 194/210 |
| 2855396 | 6/1979 | Fed. Rep. of Germany | 194/210 |
| 0292594 | 11/1989 | Japan | 194/210 |
| 2098768 | 4/1982 | United Kingdom . | |
| 2211976 | 7/1989 | United Kingdom | 209/534 |

*Primary Examiner*—Robert J. Spar
*Assistant Examiner*—Scott L. Lowe
*Attorney, Agent, or Firm*—Ostrolenk, Faber, Gerb & Soffen

[57] ABSTRACT

A thread detector assembly for detecting an activated, elongate thread which is integral with a sheet comprises an elongate detector or set of detectors. A conveyor is provided to cause relative movement between a sheet and a detector. The detector or detectors extend at an acute angle to the thread in use whereby the thread is presented successively to different parts of the detector or detectors.

16 Claims, 4 Drawing Sheets

THREAD DETECTOR ASSEMBLY

FIELD OF THE INVENTION

The invention relates to a detector assembly and method for detecting an activated, elongate thread on or in a sheet.

DESCRIPTION OF THE PRIOR ART

The use of threads for security purposes, such as magnetic or luminescent threads, is well known in the field of security documents such as banknotes. A conventional magnetic security thread detection system comprises a magnetization station for activating the thread and a read station. The note is transported past the magnetization station and then past the read station. The function of the magnetization station is to put the magnetic material into a known magnetic state. The magnetic field generated by the material is then detected by the magnetic read head at the detection station.

Some magnetic threads are coded: that is they are not made from continuous, relatively uniform strips of material, but are composed of a number of areas, some of which contain magnetic material, and some of which contain magnetic material of different properties, or no magnetic material at all. The pattern of the magnetic material(s) on the thread may be used to encode banknotes so that the denomination, date of issue, etc. may be determined.

An existing design for reading the code when the notes are transported with the long edge leading uses a permanent magnet to magnetize the material, and a conventional magnetic read head assembly to detect the presence and pattern of the thread (GB-A-2098768). The head assembly must be sufficiently wide so that it covers the part of the transport in which the thread will appear, given all feed tolerances and thread position tolerances. Such an arrangement is not possible for notes transported with the short edge leading. A single large head would not be able to distinguish the magnetic pattern, and so one or more arrays of heads would be necessary. The size of each head can be no larger than the separate magnetic areas, and the array has to span the note (or at least a large part of it). A typical magnetic area is about 2 mm high, the array of heads would typically be about 100 mm high, and so the arrays would need to contain typically 50 to 200 read heads. Each of these would need a channel of processing electronics, and so the system would be very large and expensive.

The technique described in U.S. Pat. No. 3,362,532 is another method which could be used to read coded threads, but one which presents severe difficulties for high speed banknote transports. The aim of this invention is to read the grids printed in magnetic ink behind the presidents' heads on the faces of U.S. banknotes. These may be regarded as two simple "codes" printed respectively parallel and perpendicular to the long edge of the banknote.

If we can consider that the note is transported with the short edge leading, there is no problem reading the lines perpendicular to the long edge, using a read head with a sensitive gap parallel to these lines. As the foregoing patent acknowledges, however, the lines parallel to the long edge cannot be detected by a read head whether the gap be parallel to the long edge or to the short edge. The technique of U.S. Pat. No. 3,362,532 is to move the document past the read heads at an angle (of about 45 degrees). This allows both "codes" to be read simultaneously.

It is difficult to design a high speed banknote transport which is capable of moving notes in such a manner. All practical devices move the notes in a direction substantially parallel to one edge (long or short). The problems of maintaining notes at an angle of 45 degrees, for a complete transport path or for a restricted part of a transport, are severe.

SUMMARY OF THE INVENTION

In accordance with one aspect of the present invention, a thread detector assembly for detecting an activated, elongate thread on or in a sheet comprises an elongate detector; and means for causing relative movement between a sheet and the detector and is characterized in that the detector extends at an acute angle to the thread in use whereby the thread is presented successively to different parts of the detector.

In accordance with a second aspect of the present invention, a method of detecting an activated, elongate thread on or in a sheet comprises causing relative movement between the sheet and an elongate detector such that the detector extends at an acute angle to the thread in use whereby the thread is presented successively to different parts of the detector.

The invention avoids the need for a large number of individual sensors by positioning the detector at an acute angle to the thread.

In one example, a single detector is provided whereas in other examples, a set of detectors is provided, each detector extending at an acute angle to the thread in use, the detectors being arranged such that each detector detects respectively different parts of the thread. In these other examples the need for a relatively large detector is avoided. A single detector can be difficult to make and expensive, and it requires a relatively large part of the transport path. Although a number of sets of processing electronics is required, typically between two and ten depending on the number of heads, this is considerably reduced from the very large number of sets required for the large arrays discussed above while the length of the transport path required is also much less than for the system making use of a single detector. For example, if the detectors are mounted at 45 degrees to the direction of travel, four detectors 36 mm wide are needed to cover a note 100 mm high, and only about 25 mm in length of the transport are needed. There is still, therefore a large saving in system complexity and cost. Preferred numbers of detectors are in the range of two to ten most preferably four or eight.

The invention can be used with different types of thread but is particularly applicable for detecting magnetic threads.

Preferably, the assembly further comprises activation means for activating the thread. This may be an illumination system for causing the thread to luminesce, in the case of a luminescent thread, or a magnetisation station in the case of a magnetic thread.

In the preferred example, the means for causing relative movement comprises a conveyor system for moving a sheet past the or each detector head.

Although the invention is particularly suited to the detection of threads in individual sheets, it can also be used for detecting threads on continuous webs. In addition, the assembly can be used for detecting threads which may be arriving at the head from a variety of directions.

BRIEF DESCRIPTION OF THE DRAWINGS

Three examples of assemblies and methods according to the invention will now be described with reference to the accompanying drawings, in which.

DETAILED DESCRIPTION OF THE EMBODIMENTS

Figure 1A:
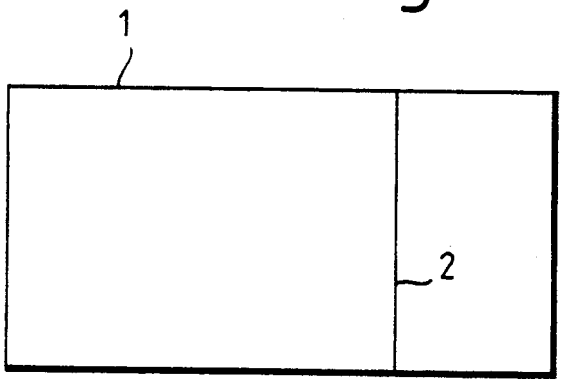
FIG. 1A illustrates a typical banknote having a thread.
Figure 1B:
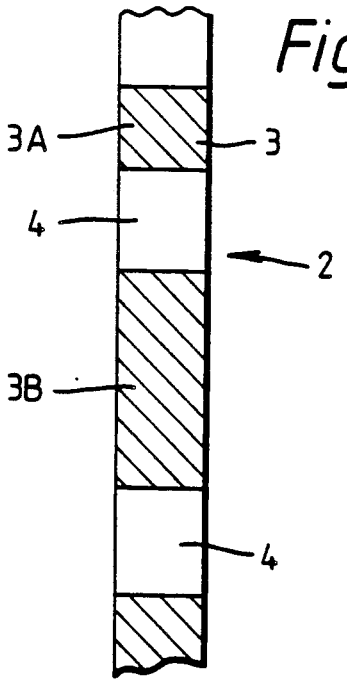
FIG. 1B illustrates an enlarged portion of a security thread.

FIG. 1A illustrates a conventional banknote 1 having a security thread 2 extending parallel with its short side. The security thread includes portions of magnetic material 3 some of which can be seen in the enlarged view of FIG. 1B. Typically, the thread has a width of between 0.5 and 1.0 mm and each portion has a length of 1.0 to 2.0 mm. Thus, in the section of the thread 2 shown in FIG. 1B, there is shown a single portion 3A and a double portion 3B. These portions 3A, 3B are separated by regions 4 which contain no magnetic material or material of different magnetic properties. The selection of portions 3A, 3B etc. is used to encode the security thread.

Figure 2:
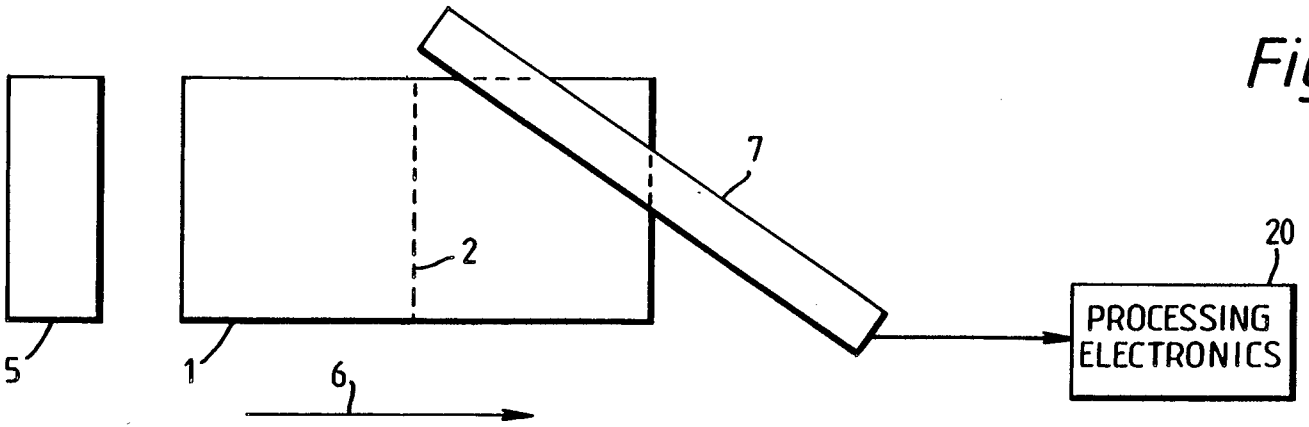
FIG. 2 illustrates schematically one example of a detector assembly.

FIG. 2 illustrates schematically one example of an assembly for detecting the security thread 2. The apparatus comprises a magnetization station 5 of conventional form under which the banknote 1 is fed in a direction 6 with its short edge leading by a belt conveyor system of conventional form (not shown). Downstream of the magnetization station 5 is positioned an elongate magnetic read head 7. The head 7 is inclined at an angle of about 45° to the direction of the thread 2. This is the preferred angle although other angles may be used. If the angle were much more acute, the head would occupy a longer part of the transport; if it were less acute, the discrimination of the signals, for example from the separate bars of a code, would deteriorate. It is immaterial as to whether the top of the head is angled towards or away from the direction of travel.

It will be seen from FIG. 2 that as the note is transported under the head 7, successively lower parts of the thread pass under corresponding lower parts of the head and the thread is effectively scanned along the head. The head 7 generates an electrical signal representing the strength of the total incident magnetic field which will effectively equal the magnetic field due to the appropriate part of the thread 2 and this electrical signal is output as a single channel to remote processing electronics 20, in a conventional manner.

Figure 5:
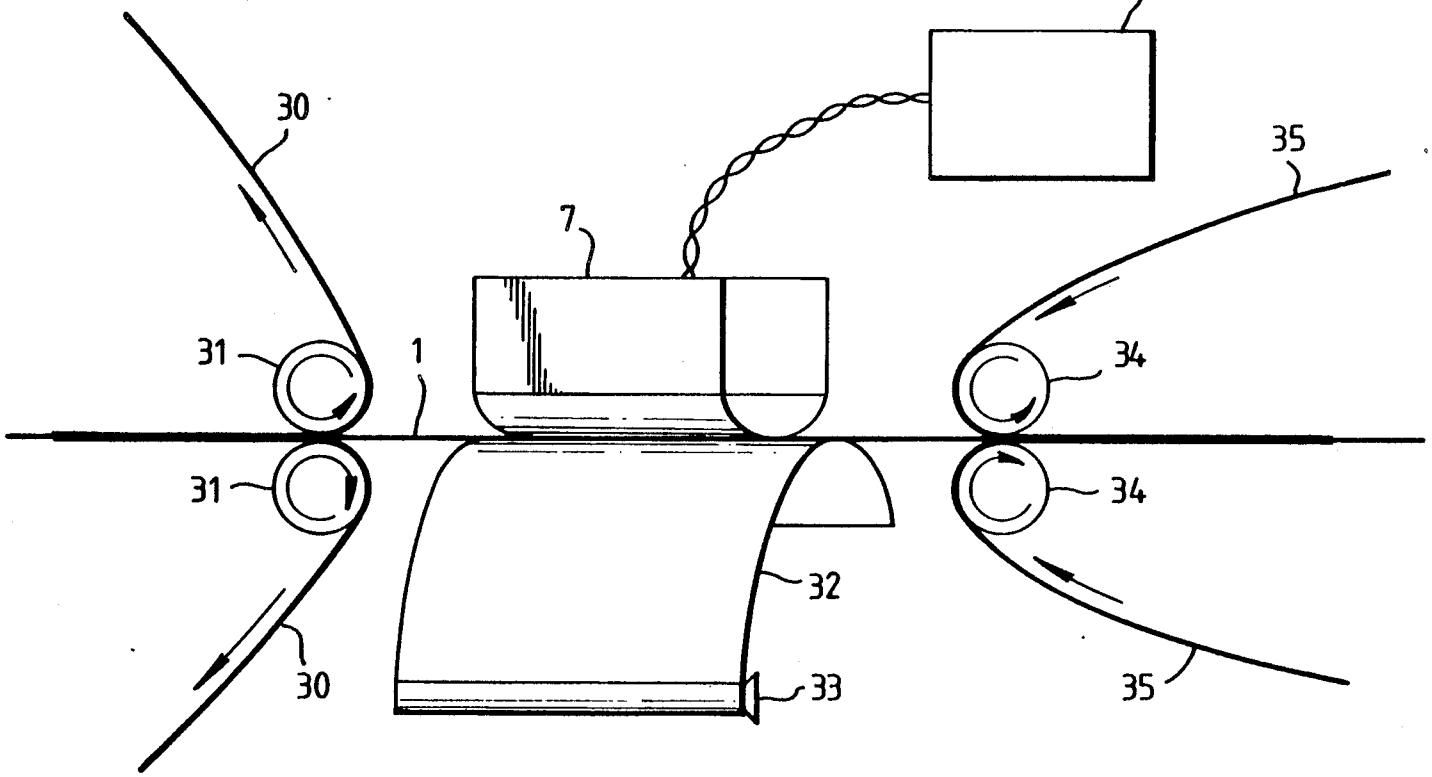
FIG. 5 illustrates the FIG. 2 apparatus in more detail.

FIG. 5 illustrates in more detail part of the apparatus shown in FIG. 2. In this example, banknotes 1 are fed between input belts 30 of a transport system, the belts being entrained around rollers 31. The banknotes 1 exit from between the rollers 31 into a nip defined between the magnetic read head 7 and a spring loaded guide 32 secured to an anchorage 33. The spring loaded guide 32 maintains the note in contact with the magnetic head 7 through which it is pushed by movement of the belts 30 until the leading end of the banknote is received between rollers 34 about which are entrained respective output belts 35 of the transport system.

Figure 3:
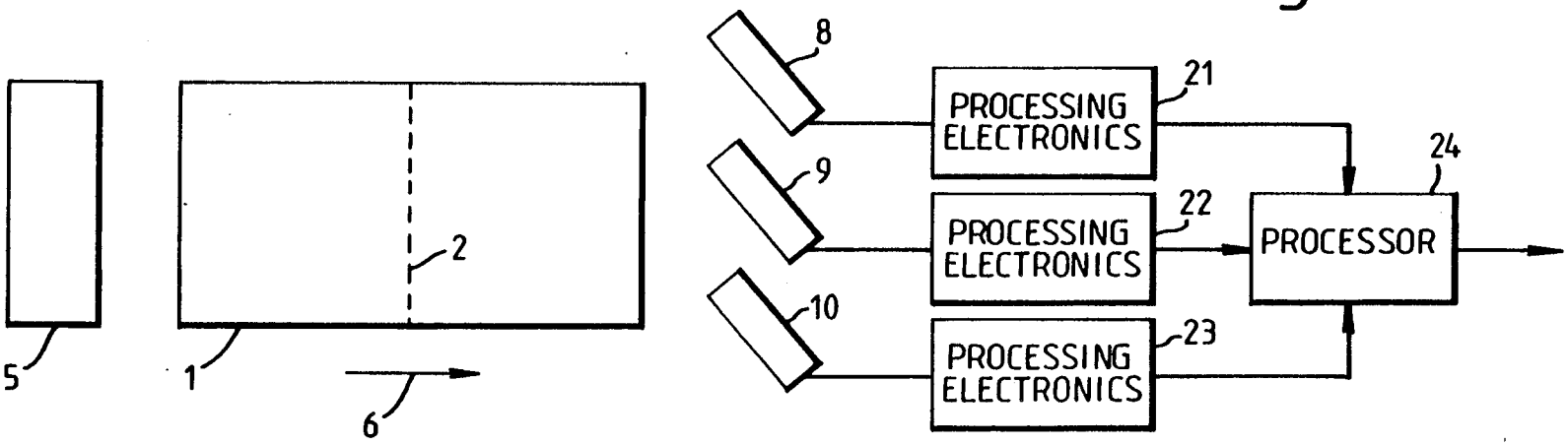
FIG. 3 illustrates a second example of a detector assembly.

In some cases, the FIGS. 2 and 5 arrangement may lead to the need for a large head which can be difficult to make and expensive. Furthermore, a relatively large part of the transport path is taken up by the head. FIG. 3 illustrates a modified assembly in which the head 7 is replaced by three shorter heads 8–10 arranged substantially parallel with each other in a line orthogonal to the direction of travel 6 of the note 1. Each head 8–10 scans a respective part of the thread 2 and generates an output signal which is a function of the part of the thread which is scanned. In this case, three sets of processing electronics 21–23 are required, one for each head, each comprising an amplifier, peak detector and analogue store (all not shown), connected to a processor 24 which combines the signals from electronics 21–23 to generate a resultant signal defining the thread, but the cost and complexity of this will not be as high as the cost and complexity of a system containing 50 to 200 detectors, as discussed earlier.

Figure 4A:
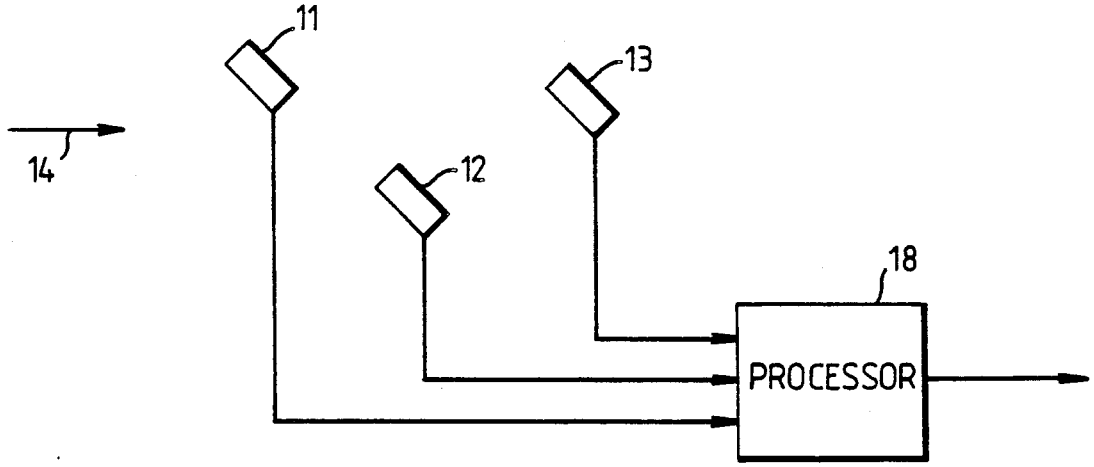
FIG. 4A illustrates a third example of a detector assembly.
Figure 4B:
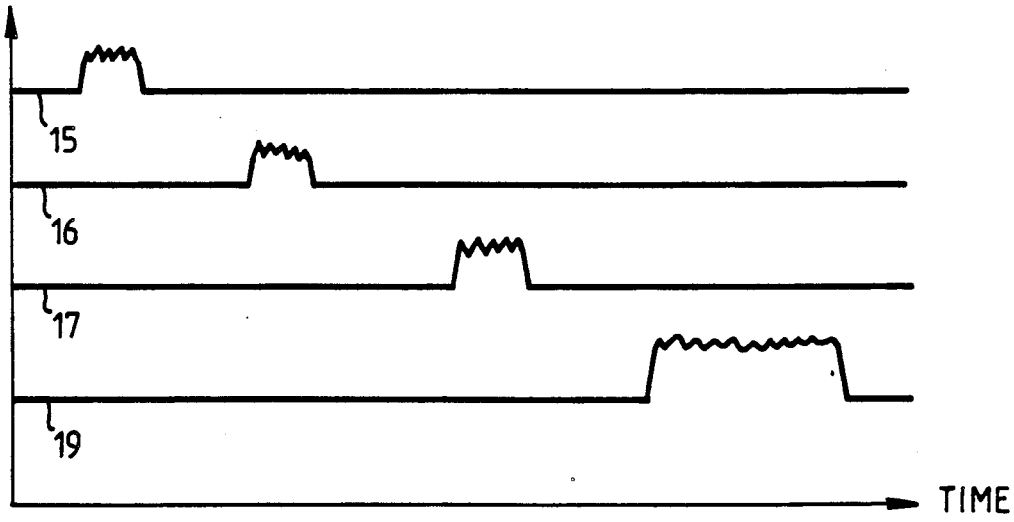
FIG. 4B illustrates output signals from the FIG. 4A assembly.

FIG. 4A illustrates a further example in which three elongate detector heads 11–13 are provided. Each head 11–13 is positioned at an angle to the direction of movement of a banknote, as indicated by an arrow 14 and the heads are also offset from one another in the direction of motion and transverse to that direction. The output signals from the heads 11–13 are shown by traces 15–17 respectively in FIG. 4B. As can be seen in FIG. 4B the output signals from the heads 11–13 are displaced in time from one another and so to achieve a single output, the three signals are fed to a processing circuit 18 which consolidates the signals and generates an output trace 19 representing the whole thread.

The manner in which signals are processed from each of the heads will be readily apparent to a person skilled in the art. For example, for each signal, in the case of multi-head systems such as that shown in FIG. 3, each of the processing electronics 21–23 will reprocess the signals from the respective head and then digitize these signals while delaying the signals according to the positions of the relevant heads in the transport. The digitized and delayed signals will then be fed to the processor 24 which will sum the delayed signals to produce a "complete" trace of a thread (in the case of a security thread) and will further process the overall signal (in the case of a bar code) to produce a stream of pulses which represents the bar pattern. The technique used to determine the code would depend on the design of the code.

We claim:

1. In a thread detector assembly for detecting an activated, elongated thread which is integral with a sheet, and which comprises a plurality of spaced apart code portions each extending in a first direction, said assembly comprising:

an elongated detector; and means for causing relative movement between said sheet and said detector, said relative movement being in a direction substantially perpendicular to said first direction; and said detector extending at an acute angle to said direction of relative movement whereby the thread is presented successively to different parts of said detector.

2. An assembly according to claim 1, wherein said detector is adapted to detect magnetic properties of the thread.

3. An assembly according to claim 1, further comprising activation means for activating the sensed property of said thread.

4. An assembly according to claim 1, wherein said means for causing relative movement comprises a conveyor.

5. An assembly according to claim 1, wherein said detector extends at substantially 45° to said direction of relative movement.

6. An assembly according to claim 1, wherein said plurality of spaced apart code portions are each positioned along a common imaginary line extending in said first direction.

7. A method of detecting an activated, elongated thread which is integral with a sheet, and which comprises a plurality of spaced apart code portions each extending in a first direction, said method comprising the steps of:

causing relative movement between said sheet and an elongated detector in a direction substantially perpendicular to said first direction, said detector extending at an acute angle to said direction of relative movement, whereby said thread is presented successively to different parts of said detector; and detecting said code portions of said elongated thread as said thread is presented successively to different parts of said detector.

8. A method according to claim 7, wherein each of said spaced apart code portions are positioned along a common imaginary line extending in said first direction.

9. In a thread detector assembly for detecting an activated, elongate thread which is integral with a sheet and which comprises a plurality of spaced apart code portions each positioned along an imaginary line extending in a first direction, said assembly comprising:

a set of elongated detectors arranged side-by-side;

means for causing relative movement between said sheet and said detectors, said relative movement being in a direction substantially perpendicular to said first direction; and said detectors arranged side-by-side, each said detector extending at an acute angle to said direction of relative movement whereby each said detector detects a respective different part of said thread.

10. An assembly according to claim 9, wherein each of said detectors extends at substantially 45° to the first direction.

11. An assembly according to claim 9, wherein said set of detectors comprises 3 detectors.

12. An assembly according to claim 9, wherein said set of detectors comprises 4 detectors.

13. An assembly according to claim 9, wherein said set of detectors comprise 8 detectors.

14. An assembly according to claim 9, wherein each of said spaced apart code portions are positioned along a common imaginary line extending in said first direction.

15. A method of detecting an activated, elongate thread which is integral with a sheet and which comprises a plurality of spaced apart code portions each extending in a first direction, said method comprising the step of causing relative movement between said sheet and a plurality of elongated detectors arranged side by side, said relative movement being in a direction substantially perpendicular to said first direction, each said detector extending at an acute angle to said direction of relative movement whereby each said detector detects a respective different part of said thread.

16. A method according to claim 15, wherein said plurality of spaced apart code portions are each positioned along a common imaginary line extending in said first direction.

* * * * *